US005727782A

United States Patent [19]

Okada

[11] Patent Number: 5,727,782

[45] Date of Patent: Mar. 17, 1998

[54] AUTOMATIC SHEET FEEDER

[75] Inventor: Tomohiko Okada, Nara, Japan

[73] Assignee: Sharp Kabushiki Kaisha, Osaka, Japan

[21] Appl. No.: 702,947

[22] Filed: Aug. 26, 1996

[30] Foreign Application Priority Data

Nov. 2, 1995 [JP] Japan ..... 7-286143

[51] Int. Cl.[6] ..... B65H 3/52

[52] U.S. Cl. ..... 271/121

[58] Field of Search ..... 271/121

[56] References Cited

FOREIGN PATENT DOCUMENTS

| | | | |
|---|---|---|---|
| 5-342948 | 11/1978 | Japan . | |
| 281834 | 3/1990 | Japan | 271/121 |
| 3182442 | 8/1997 | Japan | 271/121 |

*Primary Examiner*—David H. Bollinger

[57] ABSTRACT

A feed roller is disposed opposite the bottom part of a placement tray on which a stack of sheet is placed, and a resilient pressing member made of sponge etc. is provided so that it will press the separator into surface contact with the peripheral surface of the feed roller. The separator is divided into two sections for individual functions, i.e., a separating portion which lies in a front surface contact area with the feed roller and performs a separating function of sheets, and a delivering portion which lies in a surface contact area immediately after the front surface contact area and performs a delivering function of the sheet. In order to achieve these functions, the coefficient of friction in the separating portion is set greater than that in the delivering portion and it is set lower than that of the feed roller. In this way, the separation of sheets is performed reliably through the first surface contact area and the delivering of the sheet is efficiently performed through the second surface contact area. Further, the resilient pressing member will serve to inhibit the vibrations and rattling sounds of the sheet.

8 Claims, 2 Drawing Sheets

AUTOMATIC SHEET FEEDER

BACKGROUND OF THE INVENTION (1) Field of the Invention

The present invention relates to an automatic sheet feeder for use in a printer, copier, facsimile, etc., in particular relating to an automatic sheet feeder which separates sheets, one by one, from a stack of sheets and feeds it to a desired position.

(2) Description of the Prior Art

Conventionally, provided in printer, copiers, facsimiles, etc., is an automatic sheet feeder for feeding sheets, one by one, from a stack of sheets. Particularly, in a copier, in order to transfer the toner image formed on the photoreceptor to a copy paper, an automatic sheet feeder is installed in the apparatus so that, before a sheet as a copy paper is delivered to the transfer station, the sheet should be separated from a stack of sheets and then be delivered to the interior of the apparatus. Similarly in a printer, in order to record desired information of image to a sheet, a sheet feeder is installed in the apparatus so that, before a sheet is delivered to the recording station, the sheet should be separated from a stack of sheets so that a single paper will be delivered.

A paper feeder is provided not only to facilitate image recording, but for the copier to feed documents from a stack of sheets one by one in order to convey them to an exposure scanning position. Further, a facsimile apparatus also has a paper feeder which feeds a document one by one to an image pickup position where each document is exposed to light.

In accordance with a variety of the sheet feeders described above, sheet-by-sheet feeding is performed by causing a sheet of copy paper, recording paper, etc., or a sheet of document such as original documents, stacked on a tray, to pass through a nip between a feed roller and a frictional separator which is in contact with the outer peripheral surface of the roller. One example of automatic sheet feeders which separate a sheet and deliver it in the above manner, has been revealed in Japanese Patent Publication Sho 53 No.42,948.

The aforementioned automatic sheet feeder includes: as shown in FIG. 1, a sheet placement tray 40 having a slanted placement surface; a feed roller (paper feed roller) 41 which is able to rotate and is disposed near the bottom of the sheet placement tray 40; and a sheet pressing member 44 which is composed of a concaved surface 42 facing the outer peripheral surface of this feed roller 41 and a convexed surface 43 connected to surface 42, wherein a surface area 45 of concaved surface 42 near to conveyed surface 43 is made to be in contact with the outer peripheral surface of the aforementioned feed roller 41 while the other surface area 46 of the concaved surface 42 is separated by a predetermined distance from the outer peripheral surface of feed roller 41. In this geometry, these components are set so that a first coefficient of friction ($\mu 1$) between a sheet and the peripheral surface of feed roller 41 as well as a second coefficient of friction ($\mu 2$) between a sheet and the curved surface of the sheet pressing member 44 will be greater than a coefficient of friction ($\mu 3$) between the sheets stacked on the sheet placement tray 40 while the first coefficient of friction ($\mu 1$) will be greater than the second coefficient of friction ($\mu 2$). In one word, a relation $\mu 3<\mu 2<\mu 1$ should be established to make sure that the sheets can be separated so that only the topmost sheet will be fed by the rotation of feed roller 41.

In the conventional automatic feeder stated above, sheet pressing member 44 as a sheeting separator for separating sheets is made to also serve as a pickup means for bringing the separated seat into the nip of the sheet separating portion and as a feeding means for feeding the sheet to the next conveying means. Because of this, even if a sheet was definitely separated, the delivery of the sheet might be obstructed by the sheet pressing member when the sheet is fed to the next conveying means. Thus, the feed jam or sheet stoppage could occur.

In order to avoid the above situation, the coefficients of friction of the feed roller and the sheet pressing member should be set exactly so that the coefficients of friction among the sheet, sheet pressing member 44 and feed roller 41 as well as the conveying force will constantly satisfy the following conditions (a) and (b):

Friction ($\mu 3$) between sheets<Friction ($\mu 2$) between a sheet and the sheet pressing member<Friction ($\mu 1$) between a sheet and the feed roller — formula (a)

Conveying force=(Applied pressing force)×(Coefficient of friction of a sheet to the feed roller)−the other load (load derived from the conveying passage, electrostatic forces between sheets, etc.)>0 — formula (b)

Although the above conditions could have been achieved in the initial setup, the sheet pressing member and the feed roller (which are usually made from rubber-like materials) were likely to become dirty with paper dust etc. Further, in practice, the variance of the materials constituting those components, the deterioration with age, friction, static electricity and other influences, made it very difficult to constantly maintain the above conditions (a) and (b).

Moreover, when the coefficient of friction of the sheet pressing member against the sheet becomes close to the coefficient of friction between the sheets, the performance of separating sheets may degrade causing double delivery of sheets. On the other hand, in the opposite condition, the conveying force and precision of sheet feeding may degrade causing misoperation of pickup (feeding). Therefore, selection of the coefficients of friction to satisfy both conditions needed a very troublesome and difficult process, thus raising the cost for the sheet feeding apparatus.

Additionally, due to the difference between the coefficient of dynamic friction and that of static friction of the sheet pressing member and sheets, the traveling of sheet becomes unstable (sometimes the sheet is conveyed fast, and stopped other times), possibly causing the sheet to vibrate and generate uncomfortable sounds or rattle.

SUMMARY OF THE INVENTION

The present invention has been devised in order to solve the above problems and it is therefore an object of the present invention to provide an automatic sheet feeder which has a simple structure capable of reliably performing sheet-by-sheet feeding without needing any troublesome consideration for coefficients of friction.

Particularly, the object of the invention is to provide a sheet feeder which is constructed so that feeding of sheets will smoothly and exactly be performed, by separating the operation of feeding sheets into two functions: the function of separating the sheets and the function of delivering the sheets.

In accordance with the first aspect of an automatic sheet feeder of the invention to attain the above objects, the automatic sheet feeder for feeding sheets, one by one, by separating sheets from a stack of sheets placed on a placement tray and passing the sheets between a feed roller and a separator which is in contact with the peripheral surface of the feed roller, is characterized in that the separator is pressed in surface contact with a portion of the peripheral surface of the feed roller with a predetermined pressure, and the surface contact area of the separator is separated into two sections for individual functions:

- a separating portion located at the front surface contact area on the sheet entrance side to separate sheets; and
- a delivering portion located at the rear surface contact area immediately after the front surface contact area to deliver the separated sheet.

In the above configuration, since feeding of a sheet is performed by combining the function of separating sheet with the function of delivering the sheet after the separation, the sheets which are fed to the feed roller is first made to become opposite the separating portion of the separator, so that the separation between the sheets is ensured. The thus separated sheet is then fed to the delivering portion disposed immediately after the separating portion, whereby the sheet will be conveyed by the delivering portion.

In accordance with the second aspect of the invention, in the automatic feeder having the above first feature, the separator is constructed so that the coefficient of friction ($\mu a$) in the separating portion in the front contact-surface area and the coefficient of friction ($\mu b$) in the delivering portion in the rear surface contact area satisfy the following relations:

$$\mu 3<\mu a<\mu 1, \text{ and } \mu b<\mu a$$

where $\mu 1$ is the coefficient of friction of the feed roller with a sheet, and $\mu 3$ is the coefficient of friction between sheets. Accordingly, the coefficient of friction in the above separating portion is set so as to become effective for the separation of sheets, so that the performance of separation will effectively be enhanced. In this way, the separation of sheet can reliably be performed, and the separated sheet is delivered to the next stage or delivering portion where the coefficient of friction is set lower than that of the separating portion, thus the sheet can be delivered out smoothly without being stopped by. In this configuration, since the separation of sheets can effectively be performed without causing any to be blocked or any defects of feeding halfway, it is possible to reliably perform sheet-by-sheet feeding.

In accordance with the third aspect of an automatic sheet feeder of the invention to attain the above objects, the automatic sheet feeder for feeding sheets, one by one, by separating sheets from a stack of sheets placed on a placement tray and passing the sheets between a feed roller and a separator which is in contact with the peripheral surface of the feed roller, is characterized in that the separator is pressed in surface contact with a portion of the peripheral surface of the feed roller with a predetermined pressure, and the surface contact area of the separator is separated into three sections for individual functions:

- a pickup portion located at the front surface contact area on the sheet entrance side to pick up sheets;
- a delivering portion located at the rear surface contact area after the front surface contact area to deliver the separated sheet; and
- a separating portion located at the intermediate surface contact area between the front and rear surface contact areas.

In this configuration, first, the pickup portion will effectively feed the sheets into the separating portion. That is, since the operation of the separator is separated into the separating function of sheets and the pick up function of the sheets required for sheet feeding, it is possible to efficiently feed the sheets in the pickup portion and to prevent the fed sheets from being stopped. Accordingly, the feed of the sheets into separating portion can be performed definitely so that the fed sheets will be separated one by one in the separating portion, and then the separated sheet will effectively be delivered by the delivering portion.

In accordance with the fourth aspect of the invention, in the automatic feeder having the above third feature, the separator is constructed so that the coefficient of friction ($\mu c$) in the pickup portion in the front contact-surface area, the coefficient of friction ($\mu a$) in the separating portion in the intermediate contact-surface area and the coefficient of friction ($\mu b$) in the delivering portion in the rear surface contact area satisfy the following relations:

$$\mu 3<\mu a<\mu 1, \mu b<\mu a, \text{ and } \mu c<\mu a$$

where $\mu 1$ is the coefficient of friction of the feed roller with a sheet, and $\mu 3$ is the coefficient of friction between sheets. Accordingly, it is possible to reliably perform the operation described above.

Here, in order to moderately press the separator against the feed roller, a resilient pressing member which presses at least the rear surface contact area of the delivering portion against the feed roller is provided separately from that for the surface contact area of the separating portion or for the pickup portion. This configuration assures the contact pressure against the feed roller to reliably perform the delivering function, and at the same time, the vibration of the sheet in the delivering portion can be absorbed by the resilient pressing member, thus it is possible to inhibit the generation of rattling sounds.

DESCRIPTION OF THE PREFERRED EMBODIMENTS

Embodiments of automatic sheet feeders of the invention will be explained in detail with reference to the accompanying drawings.

First Embodiment of an Automatic Sheet Feeder

Figure 1:
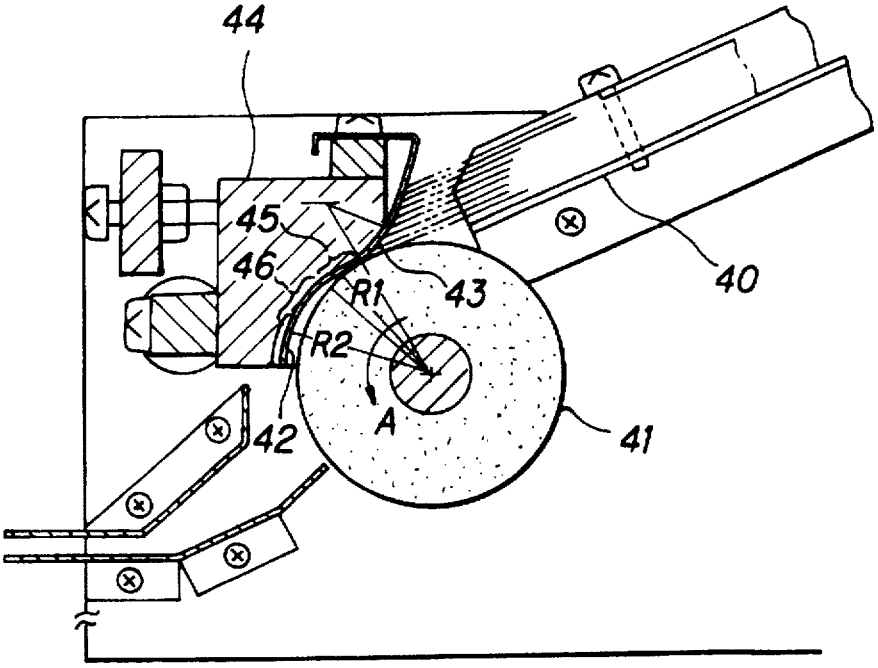
FIG. 1 PRIOR ART
FIG. 1 is a sectional view showing a conventional automatic sheet feeder.
Figure 2:
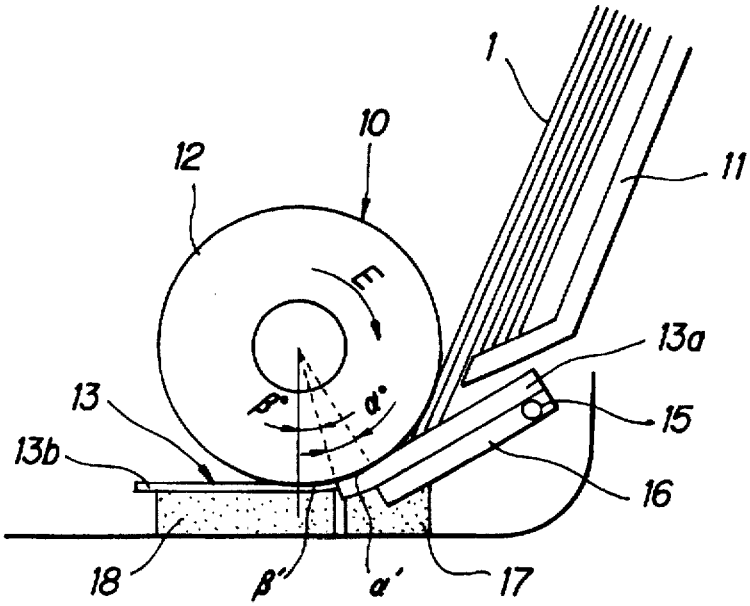
FIG. 2 is a sectional view showing a detailed structure of an automatic sheet feeder of the invention.
Figure 3:
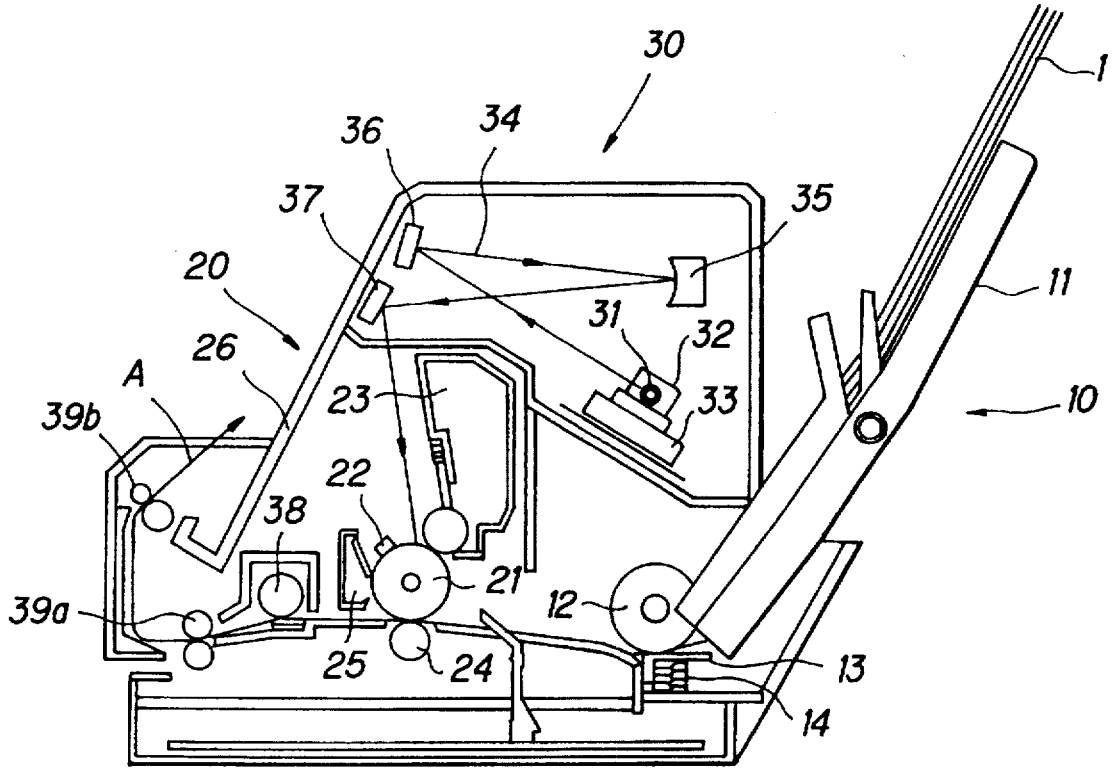
FIG. 3 is a sectional view showing the overall internal structure of a laser printer as an image forming apparatus to which the automatic sheet feeder of FIG. 2 of the invention is applied.

FIG. 2 is a sectional view showing a first embodiment of an automatic sheet feeder of the invention, and FIG. 3 is a sectional view showing the overall structure of a laser printer to which the automatic sheet feeder is incorporated.

In this embodiment, the description will be made of a case where the automatic sheet feeder is applied to a laser printer. However, the application should not be limited to the printer. That is, the invention can of course be applied to the feeding of copy sheets as well as the feeding of documents in copiers, the feeding of blank sheets as well as feeding of documents in facsimiles, etc. In short, the present invention can be applied to general sheet feeding apparatus' in which sheets should be separated one by one from a stack of sheets and be delivered to a designated position.

First, in FIG. 3, the laser printer includes: an automatic sheet feeder 10 of the invention; an image forming means 20; a laser scanning portion 30; and a fixing unit 38.

Sheet feeding means 10, which will be detailed later, delivers sheets 1, one by one, to image forming means 20 which is located inside the printer. Sheet 1 is made to pass through image forming means 20 where a toner image is transferred to the sheet, and then is made to pass through fixing unit 38 and then is discharged to the outside of the printer. That is, sheet 1 travels along a passage designated by a thick line with an arrow in the figure.

Sheet feeder 10 comprises: a placement tray 11 having a placement surface on which a stack of sheets is placed; a feed roller 12 for feeding sheets from the placement tray 11; a frictional separator (separator) 13 for separating sheets from one another; a pressing member 14 made from a sponge etc. to press the separator 13 against feed roller 12; etc. A sheet 1 fed by sheet feeder 10 is detected by a sheet detecting sensor on the way to the transfer position which faces the transfer roller comprising the image forming means 20. This detection triggers the operation of image forming.

Receiving print instructions, feed roller 12 starts to rotate so as to feed sheets placed on the placement tray 11 one by one to the interior of the printer, with the help of the function of separator 13. Sheet 1 delivered is detected by the sheet detecting sensor. In response to this detection signal, the image forming operation by image forming means 20 will be started.

Now, the configuration of this image forming means 20 will briefly be described. That is, image forming means 20 includes: a photoreceptor 21 for forming images; a charger 22 for charging photoreceptor 21 uniformly; a developing unit 23 for developing a latent image formed on the photoreceptor; a transfer roller 24 for transferring the developed image or toner image to the aforementioned sheet; and a cleaning unit 25 for removing leftover toner after the transfer. Provided over this image forming means 20 is a laser scanning portion 30 for illuminating photoreceptor 21 with light in accordance with the image to be formed.

This laser scanning portion 30 comprises: a laser emitting unit 31 for emitting a laser beam; a rotational scanning mirror 32; a scanning mirror motor 33; and reflecting mirrors 34, 35 and 36, and illuminates photoreceptor 21 with laser beams. In this way, a static latent image will be formed in accordance with the illuminated status by the laser beams.

Accordingly, once the image forming operation by image forming means 20 is started, the above laser scanning portion 30 starts its operation so that laser emitting unit 31 is controlled and driven in accordance with the image information. Meanwhile, the surface of the photoreceptor 21 has previously been charged by charger 22, and is exposed to the illumination of laser beams, thus a static latent image is formed on photoreceptor 21 in accordance with the illuminated light. Then the latent image is developed in developing unit 23. The toner image thus developed is electrostatically transferred by means of transfer roller 24, to the aforementioned sheet 1 which has been delivered in synchronism.

The sheet 1 after the transfer carries a toner image on its surface, and is made to pass through fixing unit 38. Then, the sheet passes through discharge rollers 39*a* and 39*b* to an output tray 26 which is formed as an outer panel of the printer body.

Automatic sheet feeder 10 for sheets in accordance with invention, as has been briefly described above, has placement tray 11 on which a stack of sheets 1 is placed. The placement tray 11 is disposed at an angle. Feed roller 12 and separator 13 which abuts this feed roller 12, are provided around the bottom part of the tray. Thus, the sheet feeding means for feeding sheet by sheet is configured.

Next, FIG. 2 shows, in detail, an example of automatic feeder 10 of the invention. In this figure, sheets 1 placed on placement tray 11, specifically, some or several number of sheets fall down at a time, onto a right-half portion 13*a* of separator 13 by gravity, as shown in FIG. 2. Separator 13 is formed from a single sheet-like, friction-causing material such as a rubber etc. In the figure, right-half portion 13*a* is securely supported by the top surface of a separator-pressing plate 16 whose one end side is supported rotatably on the body frame by a pivot 15. Further, the right-half portion or separating portion 13*a* of separator 13 is urged toward the feed roller 12 by means of a resilient pressing member 17 made from a sponge etc. A delivering portion 13*b* on the left side of separator 13 is securely supported by another resilient pressing member 18 made from a sponge etc. so that the delivering portion 13*b* is pressed against feed roller 12 by this resilient pressing member 18.

Separator 13 is configured to perform different functions. Particularly, separating portion 13*a* separates one sheet from another to exactly perform sheet-by-sheet feeding, while delivering portion 13*b* definitely delivers the separated sheet to the next stage. In order to attain these functions, separator 13 is pressed against feed roller 12 by means of resilient supporting members 17 and 18 stated above, so that it will come in surface contact with the peripheral surface of feed roller 12, in a range of angle of circumference ($\alpha+\beta$). Particularly, resilient pressing member 17 is made to elastically press separating portion 13*a* so that an area in separator 13 which corresponds to angle $\alpha$, is made to come into contact with the surface of feed roller 12. This area will be called as a front surface contact area $\alpha'$ (with respect to the direction of the sheet feeding). The other resilient pressing member 18, which is formed of a sponge etc., separately from the above resilient pressing member 17, is made to elastically press delivering portion 13*b* so that an area in separator 13 which corresponds to angle $\beta$, is made to come into contact with the surface of feed roller 12. This area will be called as a rear surface contact area $\beta'$ (with respect to the direction of the sheet feeding).

In the above geometry, three coefficients of friction, namely, the coefficient of friction ($\mu a$) between sheet 1 and separating portion 13*a* in surface contact area $\alpha'$ in separator 13, the coefficient of friction ($\mu b$) between sheet 1 and delivering portion 13*b* in surface contact area $\beta'$ in separator 13, and the coefficient of friction ($\mu 1$) between feed roller 12 and the sheet, are designated so as to satisfy the following conditions 1) and 2).

$$\mu 3<\mu a<\mu 1 \quad 1)$$

$$\mu b<\mu a \quad 2)$$

In the configuration which satisfies the above formulae, when feed roller 12 rotates in the direction of arrow E, the front parts of some or several sheets 1 being dropped by gravity will be slotted in between feed roller 12 and separating portion 13*a* of separator 13. From the relations of the above formulae, only the topmost sheet of the sheets 1 being dropped in will be conveyed further as feed roller 12 rotates, the other sheets 1 will be stopped at their current position. In other words, the topmost sheet can be separated from the remaining some or several sheets 1 as soon as the topmost one is picked up by the nip between feed roller 12 and surface contact area α' of separating portion 13*a* in separator 13 which is in contact with feed roller 12. In particular, since, from the relations of the coefficients of friction, the coefficient of friction with the sheet in surface contact area α' of separating portion 13*a* is set higher than that between sheets, the remaining sheets will stop. Further, since the coefficient of friction between feed roller 12 and the topmost sheet 1 against which roller 12 abuts, is set to be very high, only the sheet will be separated from the other sheets and be delivered to the next stage.

This singly separated sheet 1 is then delivered to the nip between feed roller 12 and the rear contact surface area β' in the delivering portion 13*b* of separator 13. In this situation, since the coefficient of friction of surface contact area β' of separator 13 against the sheet is set low, even if the sheet may have slipped somewhat and have rattled at the previous stage in surface contact area α', or alternatively, if the difference between the coefficient of dynamic friction and that of static friction as to surface contact area α' in separating portion 13*a* of separator 13 and as to the sheet, or other influences would cause the sheet to vibrate, the sheet will smoothly be conveyed immediately after that stage, that is, in surface contact area β', because no stoppage force will be exerted on the sheet by the separator 13 in this area. Accordingly, the vibration of the sheet in the previous stage can be regulated whereby generation of uncomfortable sounds can be inhibited.

Further, since, in the aforementioned contact area with delivering portion 13*b*, resilient pressing member 18 of sponge is made to press the delivering portion 13*b* against feed roller 12, the vibration of the sheet can be absorbed by the sponge so that it is possible to completely shut out the rattling sounds. Moreover, in accordance with the configuration described above, since the coefficient of friction in surface contact area β' of separator 13 is designated by the above formulae, not only the conveying performance of sheets but also the accuracy of delivering sheets after the separation can be improved.

As has been explained heretofore, in accordance with the embodiment of automatic sheet feeder shown in FIG. 2, in stead of making a single separator perform different functions, as performed in the conventional configuration, the separator is composed of two sections so that each divided section will perform individual functions, therefore individual performances, such as pickup and separating performances, delivering and vibration absorbing performances etc., can appropriately be improved and the degree of each performance can be determined easily. Moreover, since different factors will not become entangled, each performance will be able to be maintained for a prolonged period of time.

Since sponges 17 and 18 which both press separator 13 against feed roller 12 are provided separately, it is possible to perform minute adjustment as to the pickup and separating performances and the conveying and vibration absorbing performances, by appropriately selecting and changing the pressing force of these sponges or by appropriately selecting the angle of circumference against which the separator abuts. As a result, the variety in selection of material for the separator can be broadened and the minute adjustment during the design stage for determining the performances can be performed and simplified.

In this embodiment, in order to separate the functions, separator 13 is composed of two portions, namely, separating portion 13*a* and sheet delivering portion 13*b*. Therefore, the selection of the materials for determining the coefficients of friction can drastically be simplified as compared to the conventional case where sheet-by-sheet separation of sheet has been performed by a single separator. More specifically, if just the separating performance is to be improved, the coefficient of friction of the separator should be selected to be close to that of feed roller 12, within the range where the condition designated by the above formula 1) is satisfied. It is true that this condition may assure the separation, but this setup has an excessive tendency to inhibit the conveyance of the sheet, causing stagnation of the sheet at that position. On the other hand, if the coefficient of friction of the separator is set low in order to assure the sheet feeding, the separating function will be degraded, making it difficult to perform sheet-by-sheet feeding. In one word, it is very difficult to select a material for the separator which has a coefficient of friction that is able to satisfy both the aforementioned functions at the same time.

In this respect, according to the invention, the separating function and the feeding function are separated by configuring separator 13 as described above. Therefore, the coefficient of friction of separating portion 13*a* can be set lower than the coefficient of friction (μ1) of feed roller 12 with the sheet and made close to the coefficient of friction (μ1) as long as it is able to perform the separation of sheets. On the other hand, the coefficient of friction of delivering portion 13*b* may be set lower than that of separating portion 13*a*. In this way, it is possible to select each material very easily.

Thus, separator 13 can be configured by individually selecting the materials for separating portion 13*a* and delivering portion 13*b* whose coefficients of friction satisfy the above formulae 1) and 2) and putting them together. Other than this method, it is also possible to integrally form the structure of separator 13 and perform post-treatment such as roughening the surface which will be in contact with sheets in order to raise the coefficient of friction of separating portion 13*a*.

Second Embodiment of an Automatic Sheet Feeder

In accordance with the automatic sheet feeder shown in FIG. 2 described heretofore, the functions of separator 13 which will moderately be pressed into contact with feed roller 12, are separated into, namely, the separating function of sheets and the delivering function of delivering sheets. In FIG. 2, when sheet 1 is fed, if a plurality of sheets are fed in between separating portion 13*a* and feed roller 12, it can happen that the sheets might stop at that position because the friction of separating portion 13*a* has been set very high.

Figure 4:
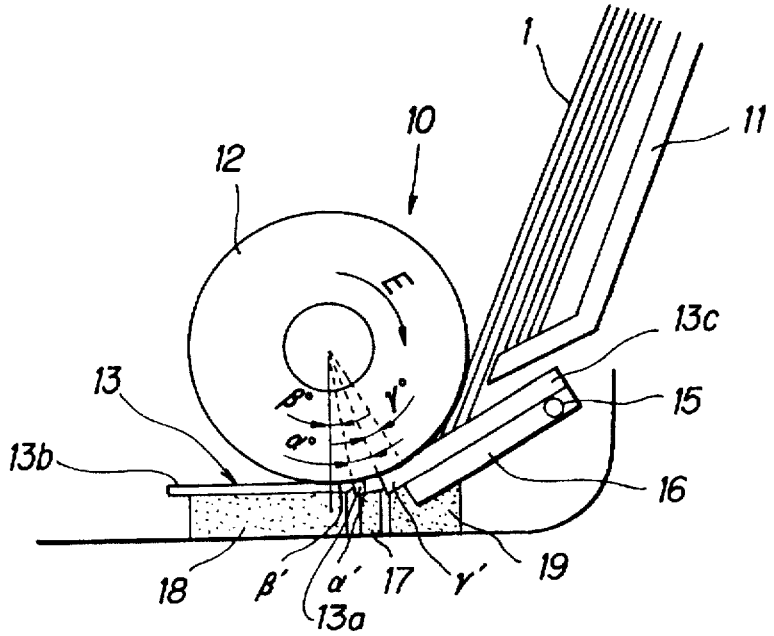
FIG. 4 is a sectional view showing another embodiment of an automatic sheet feeder of the invention.

To deal with this situation, first, it is necessary to further improve the pickup performance of the sheet. FIG. 4 shows an automatic feeder for attaining this purpose. In an automatic sheet feeder 10 shown in FIG. 4, the pickup function of separator 13 is separated from the functions of separating portion 13*a* so that the reliability and design performance of the sheet feeding can be improved more than that in the automatic sheet feeder shown in FIG. 2.

In FIG. 4, in order to separate the aforementioned pickup function of sheets and add it individually, this separator 13 has a pickup portion 13*c* for the pickup function, in the rear side thereof. This pickup portion 13*c* is rotatably supported by a separator-pressing plate 16 as mentioned before. Separator 13 is integrally formed of this pickup portion 13*c*, and a delivering portion 13*b* and a separating portion 13*a* between the former two portions.

This separator 13 is attached so as to come in surface contact with the peripheral surface of feed roller 12, in a range of angle of circumference (α+β+γ). That is, portions 13*a*, 13*b* and 13*c* of separator 13, which correspond to respective ranges of circumferential angles α, β, γ of feed roller 12, are pressed by corresponding individual sponges 17, 18 and 19.

In order to achieve the functions of separator 13, coefficients of friction in corresponding surface contact areas α', β' and γ' for separating portion 13*a*, delivering portion 13*b* and pickup portion 13*c*, respectively, are set so that the following formulae 4) to 6) will be satisfied:

$$\mu 3<\mu a<\mu 1 \quad 4)$$

$$\mu c<\mu a \quad 5)$$

$$\mu b<\mu a \quad 6)$$

where μa is a coefficient of friction between separating portion 13*a* and a sheet, μb is a coefficient of friction between the delivering portion 13*b* and the sheet, μc is a coefficient of friction between pickup portion 13*c* and the sheet, μ1 is a coefficient between feed roller 12 and the sheet, and μ3 is a coefficient of friction between the sheets.

In the configuration which satisfies the above formulae, when feed roller 12 rotates in the direction of arrow E, the front parts of some or several sheets 1 being dropped by gravity will be slotted in between feed roller 12 and pickup portion 13*c* of separator 13. From the relations of the above formulae, in surface contact area γ', the front parts of these sheet are nipped (or picked up) between feed roller 12 and separating portion 13*a* of separator 13. With a further rotation of feed roller 12, the front part of the sheets are conveyed to surface contact area α'. From the thus delivered some sheets 1, only the top most sheet 1 is separated from the rest of the sheets and fed by the frictional force of feed roller 12. The sheet is conveyed further as feed roller 12 rotates so that the front part of the sheet is delivered to surface contact area β' of delivering portion 13*b* in separator 13. The rest of the sheets is stopped at least before the surface contact area α'.

In this situation, when the coefficient of friction (μb) of surface contact area β' of separator 13 against sheet 1 is set low (lower than the coefficient of friction (μa) of separating portion 13*a*), even if sheet 1 may have slipped somewhat and rattled at the previous stage in surface contact area α', or if the difference between the coefficient of dynamic friction and that of static friction as to surface contact area β' in delivering portion 13*b* of separator 13 and as to the sheet 1, or other influences would cause sheet 1 to vibrate, the sheet will stably be conveyed immediately after that stage, that is, in surface contact area β'. Accordingly, the vibration of sheet 1 can be regulated whereby generation of uncomfortable sounds can be inhibited.

Since, in the surface contact area β' of delivering portion 13*b*, the separator is pressed by resilient pressing member 18 made of sponge, the vibration of sheet 1 will be absorbed by this sponge 18 so that the rattling sounds can completely be shut out. Further, since the coefficient of friction in contact area γ' of pickup portion 13*c* is designated by the above formulae, the conveying performance of sheets is improved and thus the accuracy of delivering sheets will also be enhanced.

In this way, in accordance with this embodiment, the separator is composed of three sections so that each of the divided sections will perform its own individual function, that is, the pickup function, the separating function or delivering and vibration absorbing functions, it is possible to enhance the design performance and the reliably as to the pickup performance and the separating performance, as compared to the sheet feeder 10 of FIG. 2 in which separating and pickup functions were performed by the same component.

In accordance with automatic sheet feeder 10 of FIG. 4, pickup portion 13*c* is to feed the sheet to separating portion 13*a* and therefore the coefficient of friction (μc) may be equal to, above or below the coefficient of friction (μb) in delivering portion 13*b*. In a word, this portion 13*c* is to definitely feed the sheet, and the magnitude of the coefficient of friction (μc) relative to that of delivering portion 13*b* is not so important, as long as it is set lower than the coefficient of friction (μa) of separating portion 13*a*.

In the sheet feeders 10 of the first and second embodiments described above, since the functional components of separator 13, namely, separating portion 13*a*, delivering portion 13*b* and pickup portion 13*c* are pressed by separately provided sponges 17, 18 and 19, respectively, it is possible to perform minute adjustment as to the pickup performance, the separating performance and the conveying and vibration absorbing performance, by appropriately selecting and changing the pressing force of these sponges or by appropriately selecting the angle of circumference against which separator 13 abuts. As a result, the variety in selection of material for the separator can be broadened.

Further, the separator 13, which was conventionally composed of a single part, is separated into plural sections, namely, separating portion 13*a*, delivering portion 13*b* and pickup portion 13*c* so that the coefficient of friction in each area can be set in accordance with the corresponding function. As a result, the manufacture can be made easy with reduced cost.

The separator may be configured by applying sheet materials having different coefficients of friction onto a single sheet in conformity with the functions of the sections, or by forming an integrated sheet made of a resin molding. In the latter case, the coefficient of friction for each section should be considered previously. Further, separator 13 will function more efficiently, if it has some degree of flexibility. For resilient pressing members 17, 18 and 19, springs other than sponge can be used to attain the similar vibration absorbing function.

In accordance with the automatic sheet feeder of the invention, since the separator to be pressed into contact with the feed roller is composed of two or three portions performing different functions, the separating performance and the accuracy of delivering sheets can be improved.

Particularly, since the delivering and vibration absorbing functional area is provided immediately after the separating functional area in the separator and is made to be pressed by a resilient member, it is possible to efficiently absorb vibrations which will be generated in the separating functional portion in the separator. Further, since the elasticity of each portion which resiliently presses a different part of the separator can be changed, it is possible to make minute adjustment of the performance of each area, thus making it possible to broaden the selection range of the materials for the separator.

It is possible to further improve the delivering performance by separating the pickup function from the separating function.

What is claimed is:

1. An automatic sheet feeder for feeding sheets, one by one, by separating sheets from a stack of sheets placed on a placement tray and passing the sheets between a feed roller and a separator which is in contact with a peripheral surface portion of the feed roller, comprising:

the separator including a first portion and a second portion;

the first portion defining a separating portion for separating the sheets and located adjacent to said placement tray;

the second portion defining a delivering portion for delivering the sheets after separating by said first portion; and plural means for resiliently pressing the separator with a predetermined pressure against the peripheral surface portion of the feed roller.

2. An automatic sheet feeder according to claim 1 wherein in said separator, the coefficient of friction ($\mu a$) of the first portion and a sheet and the coefficient of friction ($\mu b$) of the second portion and a sheet satisfy the following relations:

$$\mu 3<\mu a<\mu 1, \text{ and } \mu b<\mu a$$

where $\mu 1$ is the coefficient of friction of said feed roller with a sheet, and $\mu 3$ is the coefficient of friction between sheets.

3. An automatic sheet feeder according to claim 2 wherein in order to moderately press the separator against the feed roller, a first resilient pressing member which presses at least a rear surface of the delivering portion against the feed roller is provided and a second separate resilient pressing member is provided for a rear surface of the separating portion.

4. An automatic sheet feeder according to claim 1 further including a pressing plate having a top surface in direct contact with a back surface of the first portion.

5. An automatic sheet feeder for feeding sheets, one by one, by separating sheets from a stack of sheets placed on a placement tray and passing the sheets between a feed roller and a separator which is in contact with a peripheral surface portion of the feed roller, comprising:

the separator including:

a first portion defining a pickup portion for picking up sheets from the placement tray, a second portion defining a delivering portion for delivering sheets after they have been picked up by the first portion, a third portion located between and attached to said first and second portion, said first, third, and second portions attached in sequence, and means for pressing the separator with a predetermined pressure with the peripheral surface portion of the feed roller.

6. An automatic sheet feeder according to claim 5 wherein in said separator, the coefficient of friction ($\mu c$) of the pickup portion and a sheet, the coefficient of friction ($\mu a$) of the separating portion and a sheet and the coefficient of friction ($\mu b$) of the delivering portion and a sheet satisfy the following relations:

$$\mu 3<\mu a<\mu 1, \mu b<\mu a \text{ and } \mu c<\mu a$$

where $\mu 1$ is the coefficient of friction of said feed roller with a sheet, and $\mu 3$ is the coefficient of friction between sheets.

7. An automatic sheet feeder according to claim 6 wherein in order to moderately press the separator against the feed roller, there in provided a first resilient pressing member which presses at least a rear surface of the delivering portion against the feed roller, a second separate resilient pressing member separate from the first resilient member for pressing a rear surface of the separating portion and a third separate resilient pressing member for pressing a rear surface of the pickup portion.

8. An automatic sheet feeder according to claim 5 further including a pressing plate having a top surface in direct contact with a back surface of the first section.

* * * * *